US007245863B2

(12) United States Patent
Kamiya

(10) Patent No.: US 7,245,863 B2
(45) Date of Patent: Jul. 17, 2007

(54) METHOD AND APPARATUS OF IMAGE FORMING CAPABLE OF SUITABLY CONTROLLING TRANSFER CHARACTERISTIC

(75) Inventor: Takuroh Kamiya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 140 days.

(21) Appl. No.: 10/740,672

(22) Filed: Dec. 22, 2003

(65) Prior Publication Data

US 2004/0175198 A1 Sep. 9, 2004

(30) Foreign Application Priority Data

Dec. 20, 2002 (JP) ..... 2002-370036

(51) Int. Cl.
*G03G 15/01* (2006.01)

(52) U.S. Cl. ..... 399/301; 347/116

(58) Field of Classification Search ..... 399/298, 399/299, 301, 302, 303, 306, 308, 162; 347/116
See application file for complete search history.

(56) References Cited

U.S. PATENT DOCUMENTS 5,579,092 A * 11/1996 Isobe et al. ..... 399/39
5,697,031 A 12/1997 Kamiya et al.
6,842,602 B2 * 1/2005 Kudo ..... 399/303

FOREIGN PATENT DOCUMENTS

EP 1 387 221 2/2004
JP 4-265982 9/1992
JP 06130871 A * 5/1994
JP 08087150 A * 4/1996
JP 08234531 A * 9/1996
JP 10207167 A * 8/1998
JP 11-24507 1/1999
JP 11024507 A * 1/1999
JP 2002108169 A * 4/2002

OTHER PUBLICATIONS

U.S. Appl. No. 11/011,217, filed Dec. 15, 2004, Kamiya.
U.S. Appl. No. 10/214,742, filed Aug. 9, 2002, Yamada et al.
U.S. Appl. No. 10/214,595, filed Aug. 9, 2002, Sakamoto.
U.S. Appl. No. 10/246,623, filed Sep. 19, 2002, Kamiyama.
U.S. Appl. No. 10/373,050, filed Feb. 26, 2003, Yoshikawa et al.
U.S. Appl. No. 10/389,979, filed Mar. 18, 2003, Ogiyama et al.
U.S. Appl. No. 11/045,292, filed Jan. 31, 2005, Kamiya.

* cited by examiner

*Primary Examiner*—Robert Beatty
(74) *Attorney, Agent, or Firm*—Oblon, Spivak, McClelland, Maier & Neustadt, P.C.

(57) ABSTRACT

An image forming apparatus includes a rotating member, a drive mechanism, a scale, and a scale reading mechanism. The rotating member is configured to carry an image. The drive mechanism is configured to rotationally drive the rotating member. The scale is provided around an entire perimeter of a surface of the rotating member. The scale reading mechanism is configured to read the scale and arranged in a region where the rotating member is prevented from wavering or being distorted. A rotating drive of the rotating member is controlled based on information read by the scale reading mechanism.

14 Claims, 6 Drawing Sheets

METHOD AND APPARATUS OF IMAGE FORMING CAPABLE OF SUITABLY CONTROLLING TRANSFER CHARACTERISTIC

CROSS-REFERENCE TO RELATED APPLICATIONS

This patent specification is based on Japanese patent application no. 2002-370036, filed on Dec. 20, 2002, in the Japanese Patent Office, the disclosure of which is incorporated by reference herein in its entirety.

BACKGROUND OF THE INVENTION

1. Field of the Invention

The present invention relates to an image forming apparatus, such as a copy machine, a printer, a facsimile, and a plotter, and more particularly to the image forming apparatus having a rotatable transfer member capable of stably transferring an image on an image carrier by eliminating a variation in a transfer characteristic.

2. Discussion of the Related Art

Many electrophotographic devices, such as a color copy machine and a color printer, have a function of printing a color image.

Color electrophotographic devices can be generally classified as a one drum type and a tandem type. The one drum type includes a plurality of color developing devices disposed around one photoconductor. These developing devices deposit toner on the photoconductor to form a composite toner image and then transfer the image to develop a color image on a sheet. The tandem type includes a developing device for each of a plurality of photoconductors arranged horizontally to form a single color toner image on each photoconductor. The single color toner images are sequentially transferred to a sheet to develop a composite color image.

When comparing the one drum type and the tandem type, the following characteristics may be discerned. An advantage of the one drum type is that the one photoconductor makes the device relatively compact and inexpensive. However, the one photoconductor is required to form an image two or more times (generally 4 times) to develop a full color image. This process requires a considerable amount of time.

On the other hand, an advantage of the tandem type is that the plurality of photoconductors forms the full color image more quickly. However, the plurality of photoconductors makes the device relatively larger and more expensive.

A tandem type generally performs a monochrome printing, at a same speed as full color image formation.

The tandem type electrophotographic device includes a direct transfer system and an indirect transfer system. In the direct transfer system, four transfer units for the colors of Y, C, M, and Bk sequentially transfer images on respective photoconductors arranged horizontally to a recording sheet which is conveyed by a sheet transfer belt in a form of an endless belt. In the indirect transfer system, primary transfer units sequentially transfer images on respective photoconductors arranged horizontally to an intermediate transfer member in a form of endless belt. Subsequently, a secondary transfer unit simultaneously transfers the image to a sheet. The secondary transfer unit employs a transfer belt system. The secondary transfer unit may employ a roller system.

One exemplary image forming apparatus is described in Japanese Laid-Open Patent Application Publication No. 11-24507.

In the above mentioned systems, overlaying a plurality of color images of different colors (magenta, cyan, yellow and black toner images) on the transfer member without color shift is a significant challenge. Attempts have been made to rotate the sheet transfer belt and the intermediate transfer member at a constant rate.

One solution is to measure a surface speed with a linear encoder. The linear encoder performs a feedback control based on its output and uses the output to correct a timing for writing. This system provides alignment efficiently.

However, another problem arises. When a rotating member is an endless belt, an end of the belt is often rippled or distorted. Generally, tensioned endless belts tend to ripple at the end of the belts, causing loss in positional accuracy of liner encoders. An additional problem is that a scale for measuring a speed by linear encoders often causes static electricity, thereby affecting images and sheet conveyance.

The above-mentioned problems also apply to the one drum type color image forming apparatus. They become an impediment to enhancement of image quality.

SUMMARY OF THE INVENTION

Under an exemplary embodiment, a novel image forming apparatus includes a rotating member, a drive mechanism, a scale, and a scale reading mechanism. The rotating member is configured to carry an image. The drive mechanism is configured to rotationally drive the rotating member. The scale is provided around an entire perimeter of a surface of the rotating member. The scale reading mechanism is configured to read the scale and arranged in a region where the rotating member is prevented from wavering or being distorted. A rotating drive of the rotating member may be controlled based on information read by the scale reading mechanism. The rotating member may include a transfer member.

The above-mentioned image forming apparatus may further include an image carrier configured to carry a toner image to be transferred to the rotating member, wherein the scale reading mechanism is arranged in a region where the image carrier and the rotating member are in contact.

The above-mentioned image forming apparatus may further include a charging mechanism extending in a direction parallel to a rotating axis of the rotating member and configured to charge the rotating member under an alternate embodiment, wherein the scale and the scale reading mechanism are arranged at a region outside of the charging mechanism in a longitudinal direction. The rotating member may have an endless belt shape. The scale and the scale reading mechanism may be provided at positions arranged on an inner circumferential surface of the rotating member.

Further, under another embodiment, a novel image forming method is disclosed that includes the steps of providing a scale, driving a rotating member, reading a scale, and controlling the driving step. The providing step provides the scale at an inside surface of a rotating member driven by a driving member. The driving step drives the rotating member for rotation. The reading step reads the scale provided at the inside surface of the rotating member. The controlling step controls the driving step based on information obtained by the reading step. The rotating member includes a transfer member. The above-mentioned image forming method may further include an image carrying step for carrying a toner image to be transferred to the rotating member. Under this image forming configuration, the reading step may be arranged in a region where the image carrier and the rotating member are in contact.

The above-mentioned image forming method may further include a charging step for extending in a direction parallel to a rotating axis of the rotating member and for charging the rotating member under an alternate embodiment, wherein a scale and a scale reading mechanism are arranged at a region outside of the charging mechanism in a longitudinal direction. The rotating member may have an endless belt shape. The scale and the scale reading mechanism may be provided at positions arranged on an inner circumferential surface of the rotating member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, in which.

DETAILED DESCRIPTION OF THE PREFERRED EMBODIMENTS

Figure 1:
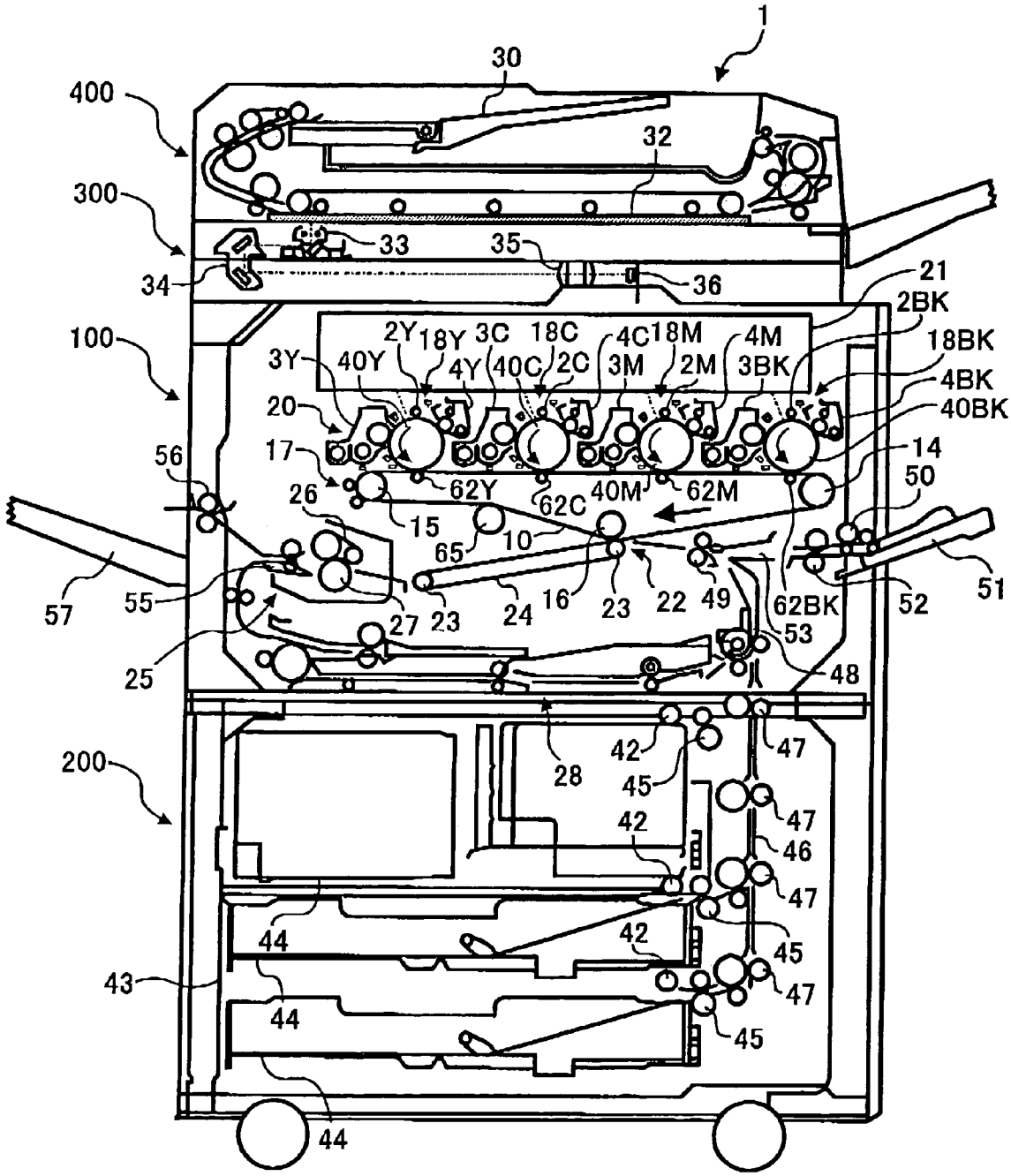
FIG. 1 is a schematic front view of an exemplary tandem type color copy machine which serves as an image forming apparatus according to a preferred embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIGS. 1 to 4, an exemplary tandem type color copy machine 1 according to a preferred embodiment of the present invention is now described.

FIG. 1 illustrates an exemplary structure and copying operation of the tandem type color copy machine 1 using an indirect transfer system.

The color copy machine 1 includes a color copying engine or assembly 100, a sheet feeding table 200 having the color copying engine 100 thereon, a scanner 300 provided on an upper surface of the color copying engine 100, and an automatic document feeder (ADF) 400 provided on top of the scanner 300.

The color copying engine 100 generally centrally includes an intermediate transfer member 10 which serves as a rotating member in a form of endless belt. The intermediate transfer member 10 includes a base layer which is coated with an inextensible fluorine resin or an extensible rubber applied to an inextensible material such as a canvas. Provided on the base layer is an elastic layer. The elastic layer is made of, for example, a fluororubber or acrylonitrile-butadiene copolymer rubber. The surface of the elastic layer is covered or coated with a smooth coat layer, such as a fluorine resin, for example.

The intermediate transfer member 10 is entrained or carried and supported on three support rollers 14, 15, and 16, and is driven to rotate clockwise, as indicated by an arrow.

In the present embodiment, an intermediate transfer member cleaning unit 17 is provided at a left side of the support roller 15. The intermediate transfer member cleaning unit 17 removes a residual toner on the intermediate transfer member 10 after image formation.

In addition, the intermediate transfer member 10, extending between the support rollers 14 and 15, is provided with a tandem mechanism 20 on top thereof. The tandem mechanism 20 includes four image forming units 18 arranged horizontally in a moving direction of the intermediate transfer member 10, for colors of yellow (Y), cyan (C), magenta (M), and black (Bk).

The tandem mechanism 20 is provided with an exposure unit 19 on top thereof. A secondary transfer unit 22 is located on a side of the intermediate transfer member 10 opposite to the tandem mechanism 20. The secondary transfer unit 22 includes a secondary transfer belt 24, which is an endless belt, extended between two rollers 23. The secondary transfer unit 22 is arranged such that a portion of the secondary transfer belt 24 close to one of the rollers 23 presses the intermediate transfer member 10 against a roller 16. The secondary transfer unit 22 transfers an image on the intermediate transfer member 10 to a recording sheet which is fed from the sheet feeding table 200.

Near the other one of the rollers 23 and below the roller 15, a fixing unit 25 is provided for fixing a toner image carried by and on the recording sheet. The fixing unit 25 is configured to press a pressure roller 27 against a fixing belt 26, which is an endless belt.

The secondary image transfer unit 22 also serves as a sheet transport mechanism for transporting the recording sheet carrying the toner image thereon to the fixing unit 25. As an alternative to the secondary image transfer unit 22, a transfer roller or a non-contact transfer charging unit may be used. Such a belt transport mechanism transports the recording sheet carrying the toner image thereon to the fixing unit 25.

In this embodiment, the color copying engine 100 is further provided with a sheet flipping unit 28 for flipping a recording sheet having a front surface already printed so as to print an image on a back surface of the recording sheet in a dual surface copying mode. The sheet flipping unit 28 is arranged under the secondary image transfer unit 22, and the fixing unit 25 substantially parallel to the tandem mechanism 20.

When a color copying is performed with the color copying engine 100, a set of originals are placed in a face-up orientation on an original input stacker 30 of the ADF 400. Alternatively, the set of originals can manually be placed sheet by sheet directly on a contact glass 32 of the image scanner 300. To do this, the ADF 400, which has a shell-like openable structure, is lifted up and, after the placement of the original on the contact glass 32, the ADF 400 is lowered to a closed position.

Then, upon depressing a start switch (not shown), when the set of originals are placed on the ADF 400, an uppermost original of the set of originals is separated and transported by a sheet transportation mechanism of the ADF 400 to the contact glass 32 of the image scanner 300 and, subsequently, the image scanner 300 is activated. First and second moving units 33 and 34 of the image scanner 300 slide or travel in a predetermined direction. When the original is manually placed on the contact glass 32, the image scanner 300 is activated upon depressing the start switch.

The first moving unit 33 that carries a light source and a mirror (both not shown) causes a light irradiation source to move and reflects the light reflected by the original to the contact glass 32. The second moving unit 34 carrying mirrors (not shown) receives the light reflected by the mirror of the first moving unit 33 and reflects the light to a read sensor 35 via an image forming lens 36.

Also, upon depressing the start switch, one of the support rollers 14, 15, and 16 is driven by a drive motor acting as a driving mechanism (not shown) to rotate the other two rollers, thereby causing the intermediate transfer member 10 to rotate. Subsequently, the image forming units 18Y, 18C, 18M, and 18Bk are driven to rotate the corresponding photosensitive drums 40Y, 40C, 40M, and 40Bk (i.e., image carriers) to form mono-color images in yellow, cyan, magenta and black on the respective photosensitive drums in the tandem mechanism 20. An image forming operation for a yellow toner image will be explained. The image forming units 40C, 40M and 40Bk for other colors are denoted by the same reference numerals as those of the image forming unit 40Y and their detailed explanations are omitted. In operation, a surface of the photosensitive drum 40Y is uniformly charged by a charging roller 2Y. Then, a laser beam is irradiated on the charged surface from an exposure unit 21, based on a scanned image data, to form a latent electrostatic image. A development mechanism 3Y develops the electrostatic latent image into a visual image as the yellow toner image.

At the same time, the intermediate transfer member 10 starts to rotate and sequentially receives the mono-color images at a same position thereof using primary image transfer units (i.e., charging mechanisms) 62Y, 62C, 62M, and 62Bk, thereby forming a composite color image. A residual toner on the surface of the photosensitive drum 40Y, which remains after transfer of the image therefrom, is removed by a photosensitive drum cleaner 4Y. Subsequently, the surface potential of the photosensitive drums 40Y is discharged by a discharging lamp (not shown) for subsequent image formation.

Further, upon depressing the start switch, one of sheet supply rollers 42 of the sheet feeding table 200 starts to rotate so that a blank recording sheet is moved to a separation roller 45 in a corresponding sheet stocker 44 among a plurality of sheet stockers 44 provided in a sheet bank 43. The separation roller 45 separates the recording sheet from the following sheets and transfers the separated sheet to a transportation passage 46. The recording sheet is moved to a transportation passage 48 leading to the color copying engine 100 by a plurality of transportation rollers 47. The recording sheet is then stopped by a pair of registration rollers 49.

When the recording sheet is manually inserted, a transportation roller 50 is rotated to move a set of recording sheets placed on a manual insertion tray 51 to a pair of separation rollers 52. Then, the pair of separation rollers 52 separate an uppermost recording sheet from the following recording sheets and transfers the separated recording sheet to the pair of registration rollers 49 through a transportation passage 53.

Subsequently, the pair of registration rollers 49 starts to rotate in synchronism with the movement of the composite color image carried on the intermediate transfer member 10 and consequently the recording sheet, which is blank, is inserted between the intermediate transfer member 10 and the secondary image transfer unit 22. The composite color image is transferred from the intermediate transfer member 10 onto the recording sheet by the action of the secondary image transfer unit 22.

After the image transfer, the secondary image transfer unit 22 transports the recording sheet having the composite color image to the fixing unit 25 which then fixes the color image to the recording sheet with heat and pressure. The recording sheet passes through an ejection passage selected by a switch pawl 55 and is ejected to the output tray 57 by the pair of sheet ejection rollers 56.

As an alternative, the recording sheet may be directed to the sheet flipping unit 28 by selecting a transportation passage for the dual surface copying mode with the switch pawl 55. In this case, the recording sheet is flipped by the sheet flipping unit 28 and is then transported again to the pair of registration rollers 49 in a face-down orientation. Then, the recording sheet passes through the passage between the intermediate transfer member 10 and the secondary image transfer unit 22 to receive a composite color image on the back surface thereof. The recording sheet with the front and back printed surfaces passes through the ejection passage selected by the switch pawl 55 and is ejected to the output tray 57 by the pair of sheet ejection rollers 56.

After the image transfer, the intermediate transfer member 10 further moves to undergo a cleaning of unused toner particles by the cleaning unit 17 and to become ready for a subsequent image transfer process.

In many cases, the pair of registration rollers 49 is grounded. The registration rollers 49 may be biased or changed to remove paper dust, for example, using a conductive rubber roller (e.g., a conductive NBR rubber). The pair of registration rollers 49 is coated with the conductive NBR rubber having a diameter of about 18 mm and a thickness of about 1 mm. An electrical resistance is about $10^9\Omega$ cm for a volume resistivity of rubbers. A surface on which toner is transferred receives about −800 voltages as an applied voltage. The back side of a recording sheet receives about +200 voltages.

Generally in intermediate transfer systems, paper dust has a low tendency to be moved to photoconductors so that little consideration is given to the paper dust to be transferred and the registration rollers may be grounded.

Alternatively, a DC bias is applied to the registration rollers 49 as an applied voltage. For charging the sheet uniformly, an AC voltage having a DC offset component may be applied.

After passing the biased registration rollers 49, the surface of the record sheet is slightly negatively charged. Therefore, transfer from the intermediate transfer member 10 to the sheet differs from the case where a voltage is not applied to the registration rollers 49.

Figure 2:
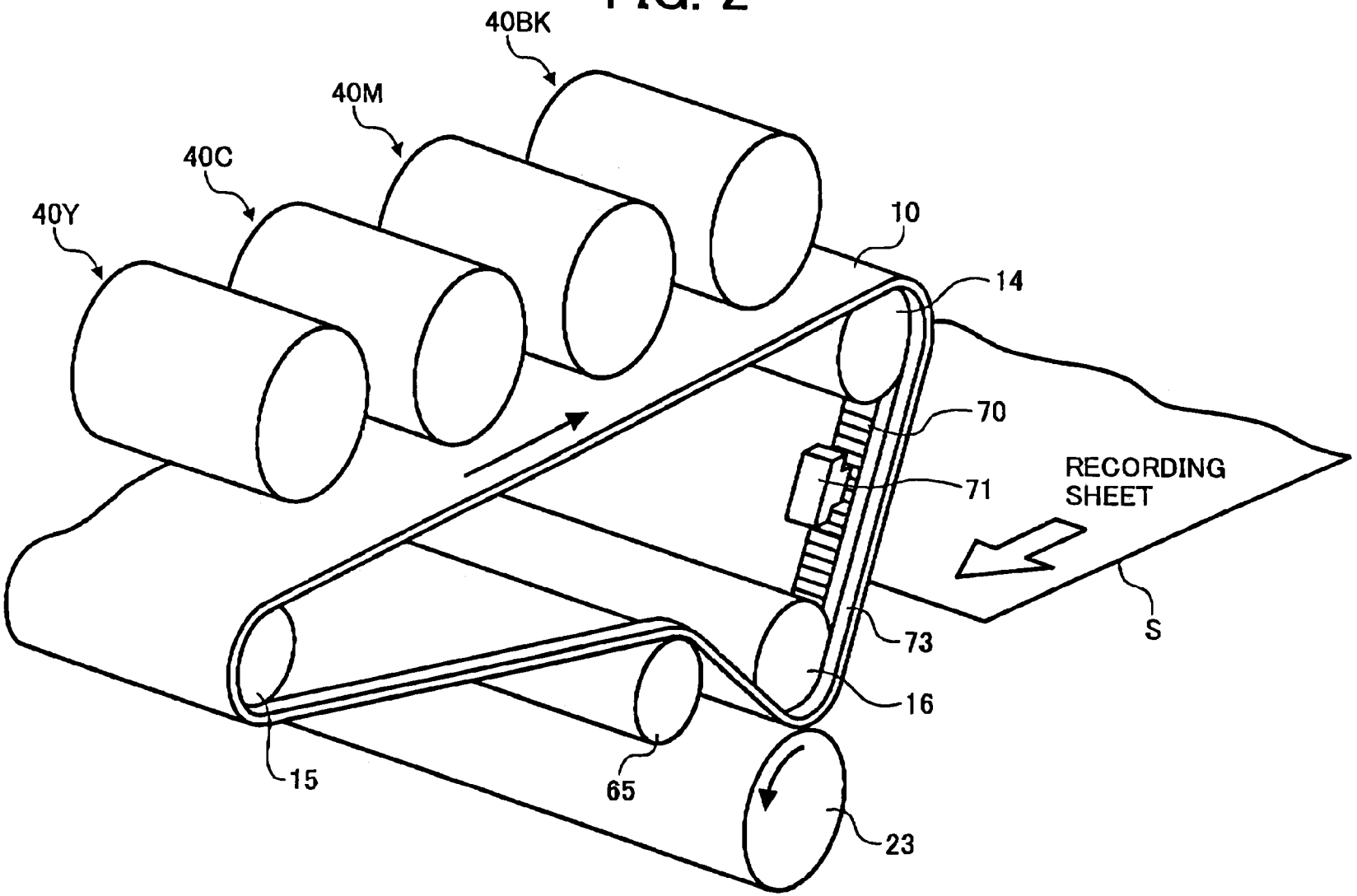
FIG. 2 is an enlarged perspective view illustrating a vicinity of an intermediate transfer member.
Figure 3:
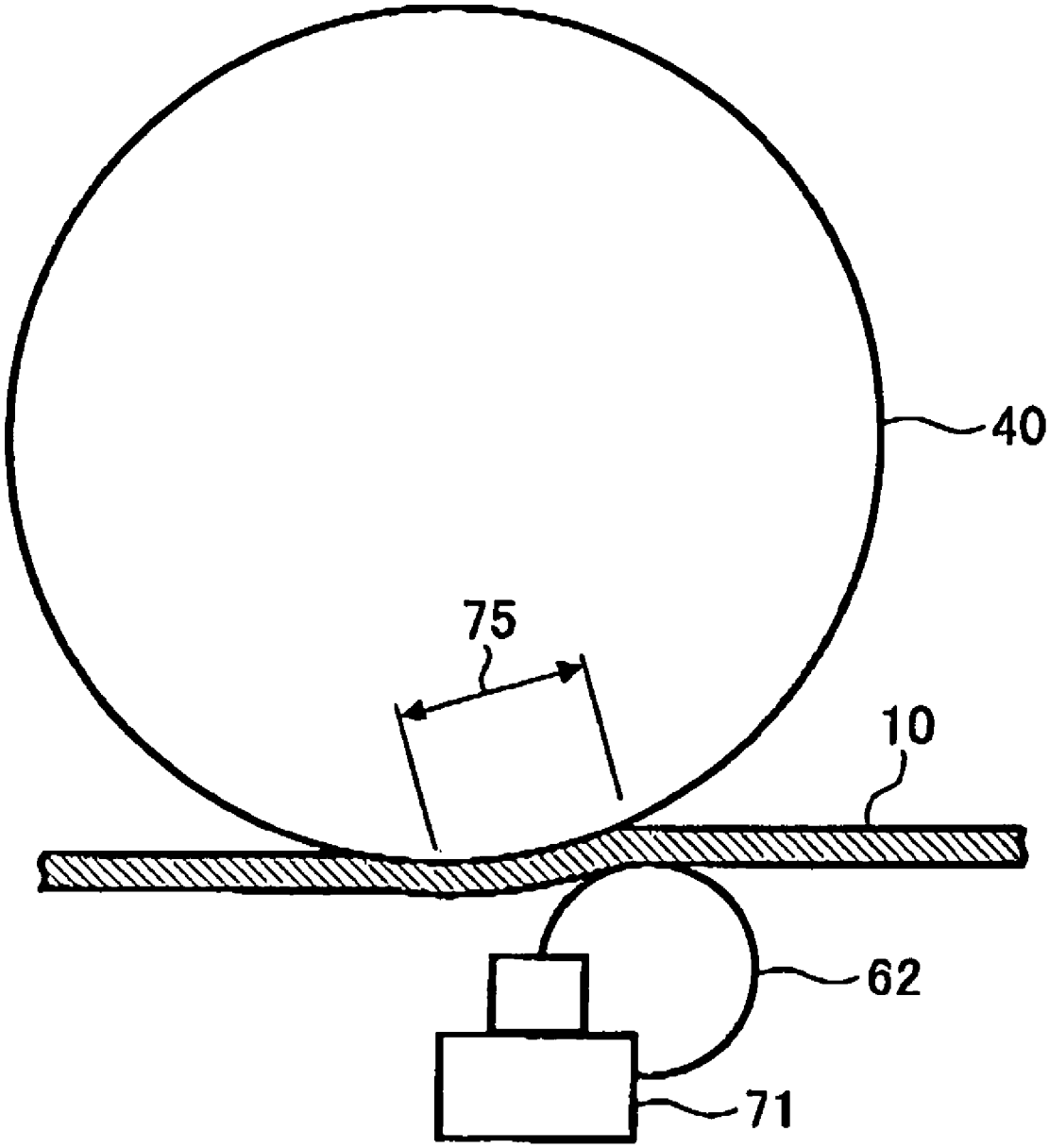
FIG. 3 is a schematic front view illustrating an installed position of a scale reading mechanism.

Referring now to FIGS. 2 and 3, a detailed structure and operation of the intermediate transfer member 10 will be described.

An optically readable linear scale 70 is formed on an inner circumferential surface of the intermediate transfer member 10 over the entire circumference or perimeter thereof. Provided adjacent to a portion of the scale 70 is a scale reader 71 for reading the scale 70.

The scale 70 has a light reflecting surface and a non-reflective surface with a fine and precise pitch alternately formed on a plastic sheet along the direction of rotation. The scale 70 is provided on an inner circumferential surface of the intermediate transfer member 10. The light reflecting surface and the non-reflective surface are formed such that material (e.g., aluminum or nickel) having a high reflection rate is evaporated and deposited on a plastic sheet and deposited material in areas which are to become the non-reflective surface is selectively removed with a laser (e.g., an excimer laser).

A scale may be directly formed on an inner circumferential surface of the intermediate transfer member 10.

The scale reading sensor 71 irradiates a beam to the scale 70 to optically read the light reflected from the light reflecting surface of the scale 70.

The scale reading sensor 71 is provided in a range or position where the photoconductors 40 and the intermediate transfer member 10 are in contact, that is, a range or position where the intermediate transfer member 10 is prevented from wavering or being distorted.

In FIG. 2, reference numeral 65 denotes a tension roller (not shown in FIG. 1).

As shown in FIG. 3, the scale reading sensor 71 is positioned at a nip region 75 where the photoconductor 40 and the intermediate transfer member 10 are in contact, as observed from the front.

Figure 4:
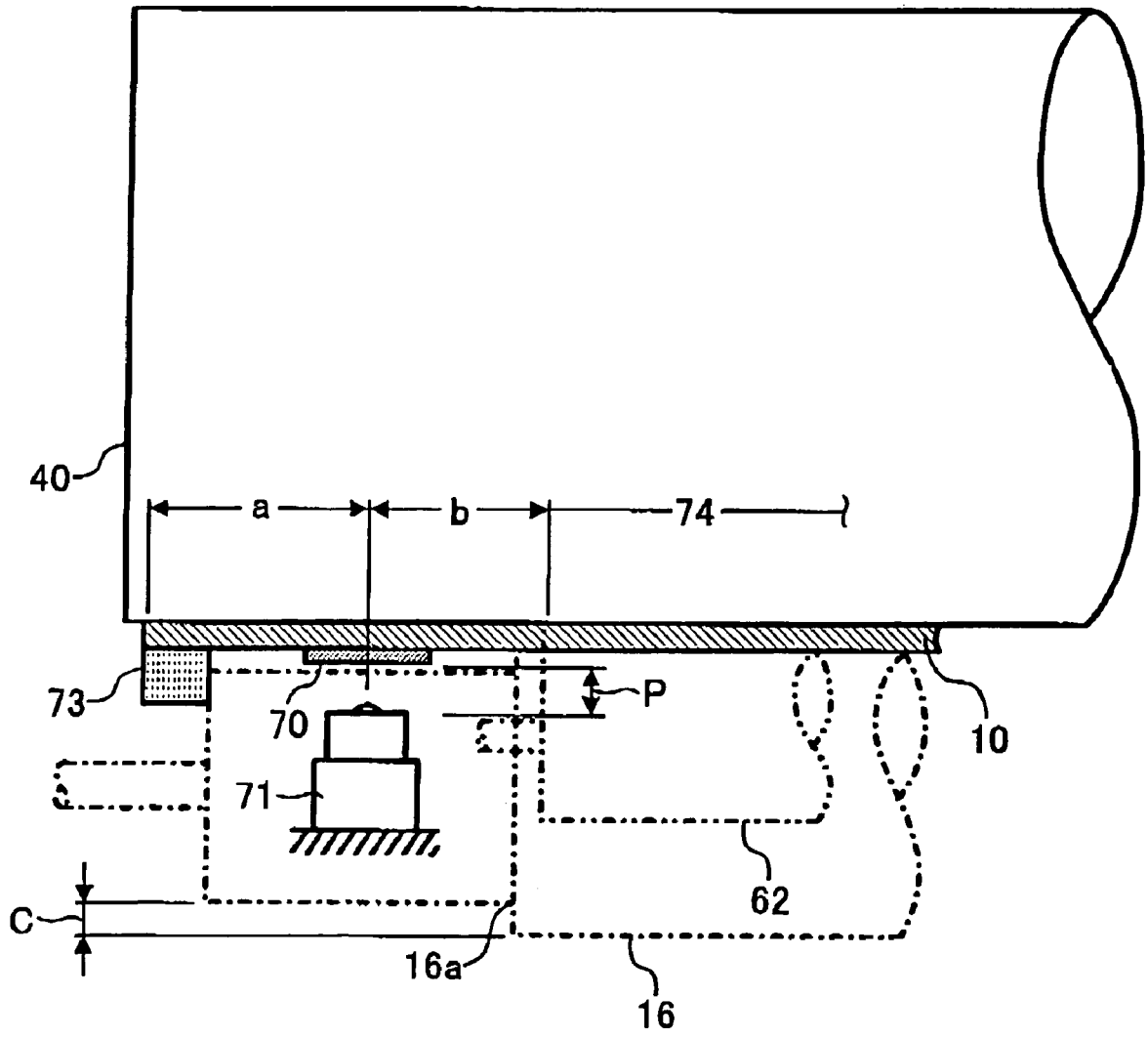
FIG. 4 is a schematic side view illustrating an installed position of a scale and a scale reading mechanism.

As shown in FIG. 4, the intermediate transfer member 10 includes a stopper 73 on its end for preventing a misalignment in a direction parallel to a rotating axis of each support roller. The stopper 73 is attached by methods such as adhesion.

The scale 70 has its centerline substantially positioned a distance (a) inward from the outer end of the intermediate transfer member 10 and a distance (b) from the outer end of an image transfer region 74, that is, a distance (b) outward from an end surface of a charging roller (i.e., primary transfer unit) 62. The scale reading sensor 71 is positioned a distance of a reading pitch (p) from the scale 70.

The secondary transfer opposing roller 16, which is a third support roller, includes a recess 16*a* so that the scale 70 has a thickness less than (c). The secondary transfer opposing roller 16 rotates within the stopper 73.

The scale 70 and the scale reading sensor 71 measure a linear velocity of the intermediate transfer member 10 to provide feedback to a drive source (i.e., a drive system) (not shown) of a drive roller (i.e., a first support roller) 14 of the intermediate transfer member 10, thereby driving the intermediate transfer member 10 with a high degree of positional accuracy. One exemplary feedback control system is described in Japanese Laid-Open Patent Application Publication No. 11-24507. Such a feedback control system includes a position sensing circuit and a velocity sensing circuit. The position sensing circuit converts a signal from the scale reading sensor 71 into a position signal. The velocity sensing circuit converts a signal from the scale reading sensor 71 into a velocity signal. In the above-mentioned system, a negative feedback control system is used for the signal from the scale reading sensor 71, the positional signal, and the velocity signal.

Figure 5:
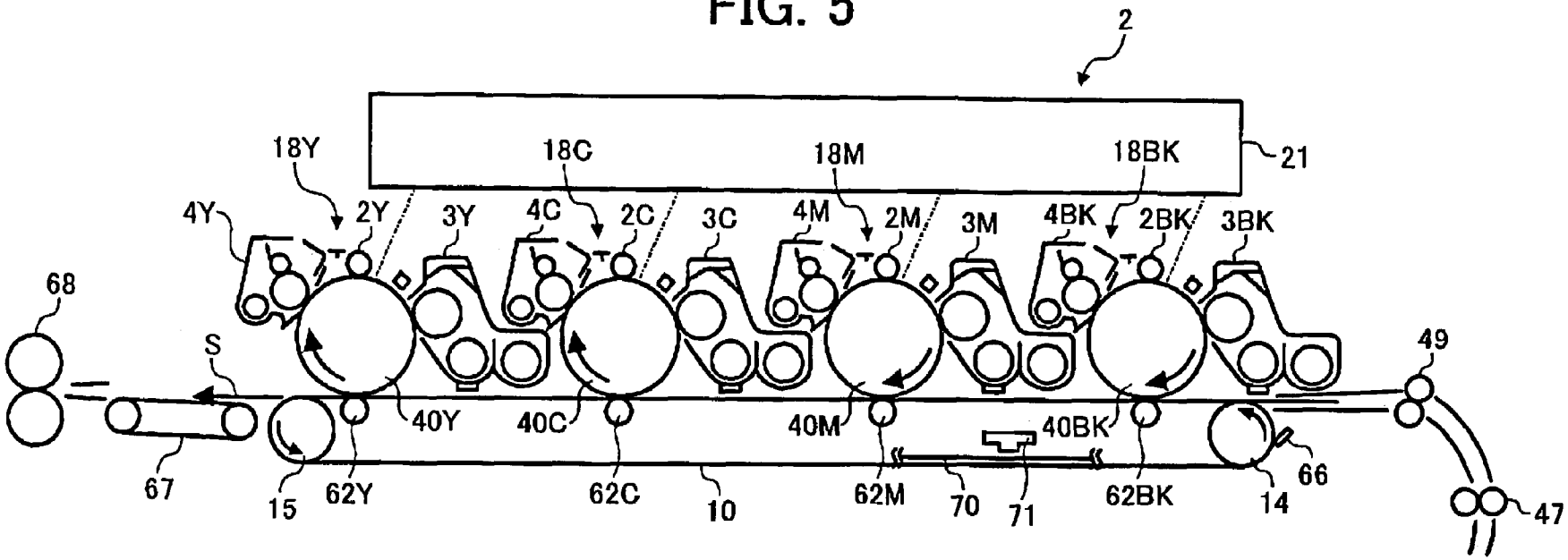
FIG. 5 is a front view of a portion of another embodiment of the present invention.

Referring to FIG. 5, a color copy machine 2 with a tandem type direct transfer system according to another preferred embodiment of the present invention is explained.

In the discussion below, components of the color copy machine 2 having similar functions to those of components shown in FIG. 1 are given the same reference numerals.

In the direct transfer system, the four transfer units 62 for the colors of Y, C, M, and Bk sequentially transfer images on the respective photoconductors 40 arranged horizontally to the sheet S which is conveyed by the sheet transfer belt 10 in the form of endless belt as the rotatable member.

In FIG. 5, the scale 70 and the scale reading sensor 71 are disposed under the sheet transfer belt 10. In practice, the scale 70 and the scale reading sensor 71 are disposed as shown in FIGS. 3 and 4. That is, the scale reading sensor 71 is provided in a range or position where the photoconductor 40 and the sheet transfer belt 10 are in contact (i.e., a range or position where the sheet transfer belt 10 is prevented from wavering or being distorted).

In FIG. 5, reference numeral 66 denotes a cleaning blade for cleaning a surface of the sheet transfer belt 10. Reference numeral 67 denotes a transfer unit. Reference numeral 68 denotes a fixing unit.

Figure 6:
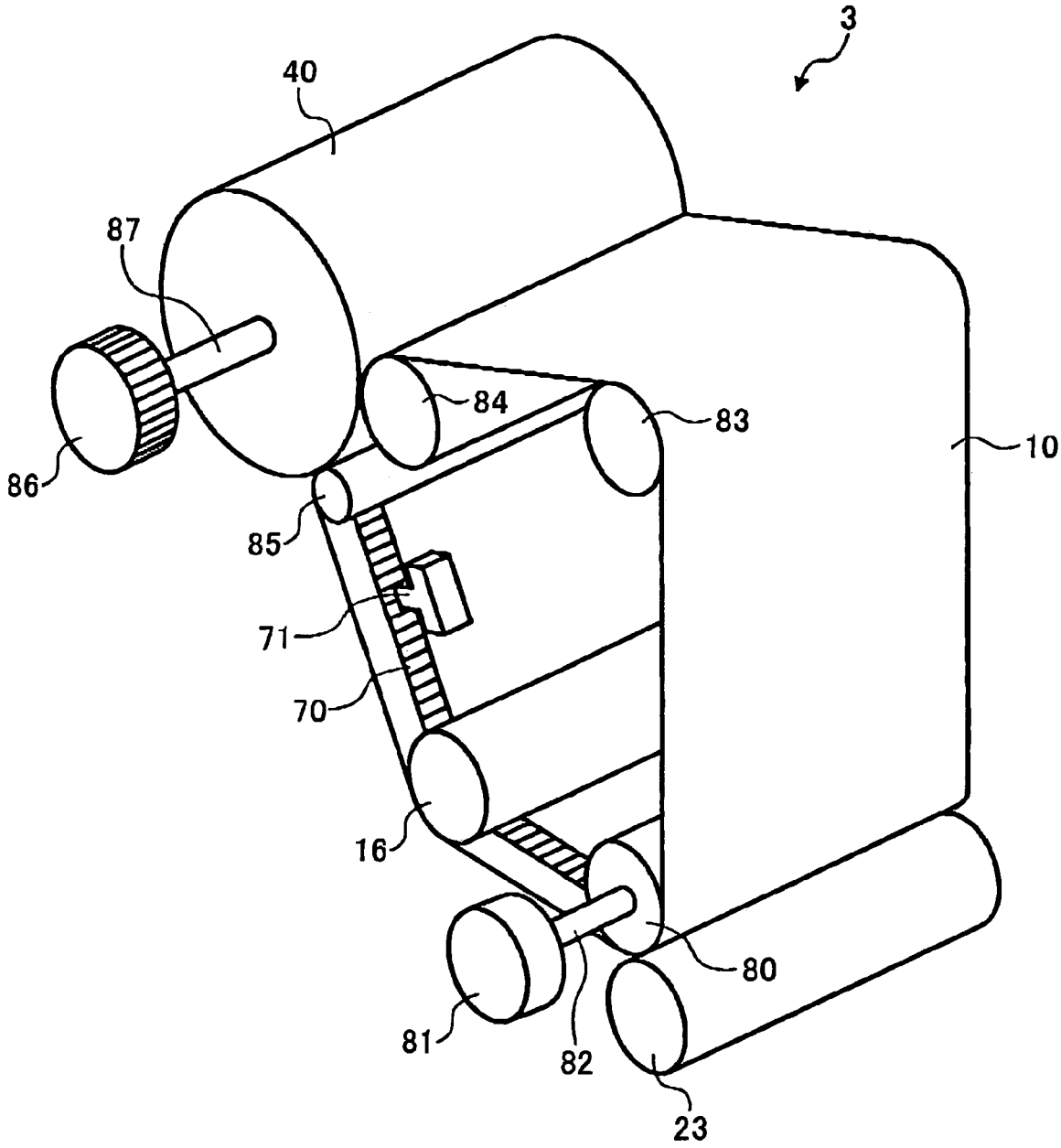
FIG. 6 is a perspective view of a portion of another embodiment of the present invention.

Referring to FIG. 6, a color copy machine 3 according to another preferred embodiment of the present invention is explained.

The color copy machine 3 is configured such that images formed on the photoconductors 40 are sequentially transferred on the intermediate transfer member 10 which is the endless belt as the rotatable member to transfer the composite color image on the intermediate transfer member 10 to the sheet by the secondary transfer roller (i.e., a secondary transfer unit).

In FIG. 6, the scale 70 and the scale reading sensor 71 are disposed between rollers 16 and 85. In practice, the scale 70 and the scale reading sensor 71 are disposed as shown in FIGS. 3 and 4. That is, the scale reading sensor 71 is provided in a range or position where the photoconductor 40 and the intermediate transfer member 10 are in contact (i.e., a range or position where the intermediate transfer member 10 is prevented from wavering).

In FIG. 6, reference numeral 80 denotes a drive roller which serves as a secondary transfer opposing roller. Reference numeral 82 donates a rotating shaft of the drive roller 80. Reference numeral 81 denotes a drive motor which serves as a driving source. Reference numeral 16, 83, 84, and 85 denote support rollers. The support roller 84 serves as a bias roller. The support roller 85 serves as a ground roller. Reference numeral 87 denotes a rotating shaft of the photoconductor 40. Reference numeral 86 denotes a gear fixed to the rotating shaft 87. The gear 86 is engaged with a gear fixed to a rotating shaft of a driving motor (not shown), thereby rotating the photoconductor 40.

Numerous additional modifications and variations are possible in light of the above teachings. It is therefore to be understood that within the scope of the appended claims, the disclosure of this patent specification may be practiced otherwise than as specifically described herein.

The invention claimed is:

1. An image forming apparatus, comprising:

a rotating member configured to carry an image;

a driving mechanism configured to rotationally drive the rotating member;

a charging mechanism having a charging roller extending parallel to a rotational axis of the rotating member and configured to charge the rotating member;

a scale provided disposed on a perimeter of the rotating member; and a scale reading mechanism configured to read the scale, the scale reading mechanism disposed in a region where the rotating member is prevented from being distorted, wherein the rotating member is controlled based on information read by the scale reading mechanism, the scale and the scale reading mechanism are arranged a predetermined distance from the charging mechanism along a line parallel to the rotational axis of the rotating member, and the scale reading mechanism and the charging mechanism partially coincide when viewed along the rotational axis.

2. The image forming apparatus as defined in claim 1, wherein the rotating member comprises a transfer member.

3. The image forming apparatus as defined in claim 1, further comprising:

an image carrier configured to carry a toner image to be transferred to the rotating member;

wherein the scale reading mechanism is disposed in a region where the image carrier and the rotating member are in contact.

4. The image forming apparatus as defined in claim 1, wherein the rotating member comprises an endless belt shape.

5. The image forming apparatus as defined in claim 4, wherein the scale and the scale reading mechanism are provided on an inner circumferential surface of the rotating member.

6. An image forming apparatus comprising:

means for carrying an image;

means for rotationally driving the means for carrying the image;

a charging mechanism having means for charging the means for carrying the image;

means for indicating information including a rotation speed of the means for carrying the image; and means for reading the information indicated by the means for indicating information, wherein the means for carrying the image is controlled based on the information read by the means for reading the information, the means for indicating and the means for reading are arranged a predetermined distance from the charging mechanism along a line parallel to a rotational axis of the means for carrying, and the means for reading and the charging mechanism partially coincide when viewed along the rotational axis.

7. The image forming apparatus as defined in claim 6, wherein the means for carrying the image comprises a means for transferring the image.

8. The image forming apparatus as defined in claim 6, further comprising:

means for transferring a toner image to the means for carrying the image.

9. The image forming apparatus as defined in claim 6, wherein the means for carrying the image comprises an endless belt.

10. An image forming method, comprising:

providing a scale at an inside surface of a rotating member at a predetermined distance from a charging mechanism along a line parallel to a rotational axis of the rotating member;

rotating the rotating member;

charging the rotating member with a charging roller of the charging mechanism;

reading a scale provided on the rotating member with a scale reading mechanism such that the scale reading mechanism and the charging mechanism partially coincide when viewed along the rotational axis; and controlling subsequent rotation of the rotating member based on information obtained by reading the scale.

11. The image forming method as defined in claim 10, wherein the rotating member comprises a transfer member.

12. The image forming method as defined in claim 10, further comprising:

carrying a toner image to be transferred to the rotating member, wherein the scale is read in a region where the image carrier and the rotating member are in contact.

13. The image forming method as defined in claim 10, wherein the rotating member comprises an endless belt shape.

14. The image forming method as defined in claim 13, wherein the scale is provided on an inner circumferential surface of the rotating member.

* * * * *